US007938312B2

(12) United States Patent
Ford

(10) Patent No.: US 7,938,312 B2
(45) Date of Patent: May 10, 2011

(54) CARTON WITH BAG CLOSURES

(75) Inventor: Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 957 days.

(21) Appl. No.: 11/623,885

(22) Filed: Jan. 17, 2007

(65) Prior Publication Data

US 2007/0187471 A1 Aug. 16, 2007

Related U.S. Application Data

(60) Provisional application No. 60/759,320, filed on Jan. 17, 2006.

(51) Int. Cl.

| | |
|---|---|
| ***B65D 3/00*** | (2006.01) |
| ***B65D 5/56*** | (2006.01) |
| ***B65D 5/00*** | (2006.01) |
| ***B65D 17/00*** | (2006.01) |

(52) U.S. Cl. ..... 229/117.3; 229/117.34; 229/117.35; 229/121; 229/241; 229/242

(58) Field of Classification Search ..... 229/117.3, 229/117.34, 121, 242, 241, 117.35, 229, 229/223, 232; 221/310; 206/233, 494; 220/495.1
See application file for complete search history.

(56) References Cited

U.S. PATENT DOCUMENTS

| | | | | |
|---|---|---|---|---|
| 1,772,625 | A | | 8/1930 | Caulfield |
| 2,139,021 | A | | 12/1938 | Johnson |
| 2,192,722 | A | | 3/1940 | Vogt |
| 2,345,486 | A | | 3/1944 | Leebov |
| 2,355,655 | A | | 8/1944 | Mabee |
| 2,365,159 | A | * | 12/1944 | Walton et al. ..... 229/117.3 |
| 2,396,310 | A | | 3/1946 | Gibson |
| 2,437,926 | A | | 3/1948 | Ball |
| 2,475,677 | A | | 7/1949 | Ringler |
| 2,509,289 | A | | 5/1950 | Dunning |
| 2,973,086 | A | | 2/1961 | Thompson |
| 3,021,002 | A | | 2/1962 | Reynolds |
| 3,033,362 | A | | 5/1962 | Marcalus |
| 3,133,688 | A | | 5/1964 | Asman |
| 3,355,089 | A | | 11/1967 | Champlin |
| 3,363,822 | A | | 1/1968 | Maulini et al. |
| 3,426,955 | A | | 2/1969 | Olson |
| 3,486,682 | A | | 12/1969 | Mahon et al. |

(Continued)

FOREIGN PATENT DOCUMENTS

DE 29 23 455 A1 12/1980

(Continued)

*Primary Examiner* — Gary E Elkins
*Assistant Examiner* — Latrice Byrd
(74) *Attorney, Agent, or Firm* — Womble Carlyle Sandridge & Rice, PLLC

(57) ABSTRACT

A carton for containing a bag having dispensable material therein. The carton comprises a plurality of panels that extend at least partially around an interior of the carton. The plurality of panels comprises a first end panel, a second end panel, a first side panel, and a second side panel. At least two end flaps respectively foldably attached to respective panels of the plurality of panels. The end flaps are overlapped with respect to one another and thereby at least partially form a closed end of the carton. A closure removably attached to the carton having an aperture for receiving at least a portion of the bag to close the bag and seal the material held therein.

24 Claims, 10 Drawing Sheets

U.S. PATENT DOCUMENTS

| | | | | |
|---|---|---|---|---|
| 3,669,345 | A | 6/1972 | Cole | |
| 3,680,766 | A | 8/1972 | Collura et al. | |
| 3,690,544 | A | 9/1972 | Meyers | |
| 3,744,702 | A | 7/1973 | Ellison | |
| 3,768,719 | A | 10/1973 | Johnson | |
| 4,262,816 | A | 4/1981 | Margulies | |
| 4,344,537 | A | 8/1982 | Austin | |
| 4,484,683 | A | 11/1984 | Werner, Jr. | |
| 4,508,218 | A | 4/1985 | Focke et al. | |
| 4,512,476 | A | 4/1985 | Herrington, Jr. | |
| 4,558,785 | A | 12/1985 | Gordon | |
| 4,572,423 | A | 2/1986 | Spencer | |
| 4,584,202 | A * | 4/1986 | Roccaforte | 426/111 |
| 4,645,108 | A | 2/1987 | Gavin et al. | |
| 4,676,394 | A | 6/1987 | Hiersteiner | |
| 4,746,019 | A | 5/1988 | Prater | |
| 4,863,052 | A | 9/1989 | Lambert | |
| 4,905,898 | A | 3/1990 | Wade | |
| 5,105,971 | A | 4/1992 | Hertenstein et al. | |
| 5,265,799 | A | 11/1993 | Stone | |
| 5,292,058 | A | 3/1994 | Zoss et al. | |
| 5,347,865 | A | 9/1994 | Mulry et al. | |
| 5,356,022 | A | 10/1994 | Tipps | |
| 5,363,981 | A | 11/1994 | Giblin et al. | |
| 5,427,267 | A * | 6/1995 | Willman | 229/117.34 |
| 5,632,402 | A | 5/1997 | Walsh et al. | |
| 5,632,404 | A | 5/1997 | Walsh | |
| 5,746,871 | A | 5/1998 | Walsh | |
| 5,783,030 | A | 7/1998 | Walsh | |
| 5,794,811 | A | 8/1998 | Walsh | |
| 5,794,812 | A | 8/1998 | Walsh | |
| 5,857,614 | A | 1/1999 | Walsh | |
| 5,918,799 | A | 7/1999 | Walsh | |
| 5,960,555 | A | 10/1999 | Deaton et al. | |
| 5,996,797 | A | 12/1999 | Flaig | |
| 6,050,484 | A | 4/2000 | Galomb | |
| 6,102,277 | A | 8/2000 | Krapohl, Sr. | |
| 6,206,279 | B1 | 3/2001 | Countee | |
| 6,352,096 | B1 | 3/2002 | Walsh | |
| 6,364,202 | B1 | 4/2002 | Zelley | |
| 6,419,151 | B1 | 7/2002 | Urtubey | |
| 6,568,586 | B1 | 5/2003 | VanEsley | |
| 6,761,269 | B2 | 7/2004 | Hamming | |
| 6,854,639 | B2 | 2/2005 | Walsh | |
| 7,025,504 | B2 | 4/2006 | Olin | |
| 7,036,714 | B2 | 5/2006 | Walsh et al. | |
| 7,210,612 | B2 | 5/2007 | Walsh et al. | |
| 7,407,087 | B2 | 8/2008 | DeBusk et al. | |
| 2001/0048022 | A1 | 12/2001 | Zoeckler | |
| 2002/0036153 | A1 | 3/2002 | Yang | |
| 2002/0055429 | A1 | 5/2002 | Walsh | |
| 2003/0144121 | A1 | 7/2003 | Walsh et al. | |
| 2004/0007614 | A1 | 1/2004 | Saulas | |
| 2004/0226989 | A1 | 11/2004 | Cook et al. | |
| 2005/0109827 | A1 | 5/2005 | Martin | |
| 2005/0127150 | A1 | 6/2005 | Walsh et al. | |
| 2005/0187087 | A1 | 8/2005 | Walsh | |
| 2005/0274782 | A1 | 12/2005 | Petrelli et al. | |
| 2006/0049067 | A1 * | 3/2006 | McDonald | 206/233 |
| 2006/0054675 | A1 | 3/2006 | Bennett | |
| 2006/0243783 | A1 | 11/2006 | Spivey, Sr. et al. | |
| 2006/0255105 | A1 | 11/2006 | Sweet | |
| 2006/0255107 | A1 | 11/2006 | Wright | |
| 2006/0266810 | A1 * | 11/2006 | Foushee | 229/101.2 |

FOREIGN PATENT DOCUMENTS

| | | |
|---|---|---|
| DE | 81 10 323.9 | 9/1981 |
| DE | 87 08 078.8 | 10/1987 |
| DE | 94 13 813 U1 | 10/1994 |
| EP | 1 457 425 A1 | 9/2004 |
| FR | 2 699 150 | 6/1994 |
| FR | 2 755 670 | 5/1998 |
| GB | 104 445 | 3/1917 |
| GB | 1 242 356 | 8/1971 |
| GB | 1 489 963 | 10/1977 |
| GB | 1 584 066 | 2/1981 |
| GB | 2 363 372 A | 12/2001 |
| WO | WO 95/28325 | 10/1995 |
| WO | WO 2006/133401 A2 | 12/2006 |

* cited by examiner

CARTON WITH BAG CLOSURES

CROSS-REFERENCE TO RELATED APPLICATION

This application claims the benefit of U.S. Provisional Application No. 60/759,320, filed on Jan. 17, 2006, the entire contents of which are hereby incorporated by reference as if presented herein in their entirety.

BACKGROUND OF THE INVENTION

The present invention generally relates to cartons for holding and dispensing dispensable material. More specifically, the present invention relates to cartons having a closure for closing and sealing the dispensable material in a bag.

Conventional cartons typically accommodate a bag, a liner, or other container used to store food products (e.g., breakfast cereal, crackers, etc.) or other dispensable material. Conventional cartons typically have a top panel formed from one or more flaps that are separable to open a top portion of the carton. The bag in the carton can then be opened and the contents of the bag dispensed through the opened carton top. Frequently, the entire amount of food product contained in the bag is not consumed in a single serving and the bag must be resealed to preserve the remaining food product for subsequent use. A disadvantage with this type of packaging is that once the sealed bag is opened, it can be difficult to reseal the bag in an airtight manner necessary to maintain freshness of the food product.

In order to close a conventional bag after the sealed top end has been opened, the user will typically fold the opened end of the bag over onto itself one or more times. Closing the bag in this way is awkward. Oftentimes, the user will simply stuff the opened end of the bag down into the carton without regard to properly sealing the opening. In humid climates, in particular, exposure of the food product to air quickly compromises the freshness of the food product. Furthermore, as additional serving portions of the food product are emptied from the bag with each use, it becomes more difficult to effectively close the open end of the bag by rolling the bag within the depth of the carton.

SUMMARY OF THE INVENTION

In general, one aspect of the invention is directed to a carton for containing a bag having dispensable material therein. The carton comprises a plurality of panels that extend at least partially around an interior of the carton. A closure is removably attached to the carton with the closure having an aperture for receiving at least a portion of the bag to close the bag and seal the material held therein.

In another aspect, the invention is generally directed to a blank for forming a carton. The blank comprises a plurality of panels comprising a first end panel, a second end panel, a first side panel, and a second side panel. At least two end flaps respectively foldably attached to respective panels of the plurality of panels. The end flaps are overlapped with respect to one another and thereby at least partially form a closed end of a carton formed from the blank. A closure panel is at least partially defined by a tear line in the blank, the closure panel having an elongate aperture therein.

In another aspect, the invention is generally directed to a method of closing a bag containing dispensable material. The method comprises providing a carton for housing the bag. The carton has a plurality of panels that extend at least partially around an interior of the carton and a closure removably attached to the carton having an aperture. The method further comprises at least partially removing the closure from the carton and closing the bag by inserting at least a portion of the bag through the aperture in the closure to seal the material therein.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMIPLAR EMBODIMENTS

The present embodiments are addressed to a carton having bag closure features that allow, for example, the opened end of a bag, container, or other vessel accommodated within the carton to be at least partially closed or sealed. In the illustrated embodiment, a single carton is provided with three separate bag closure features. In practice, any one, two, or all three of the bag closure features described in this application can be provided in a carton according to the present invention.

Figure 1:
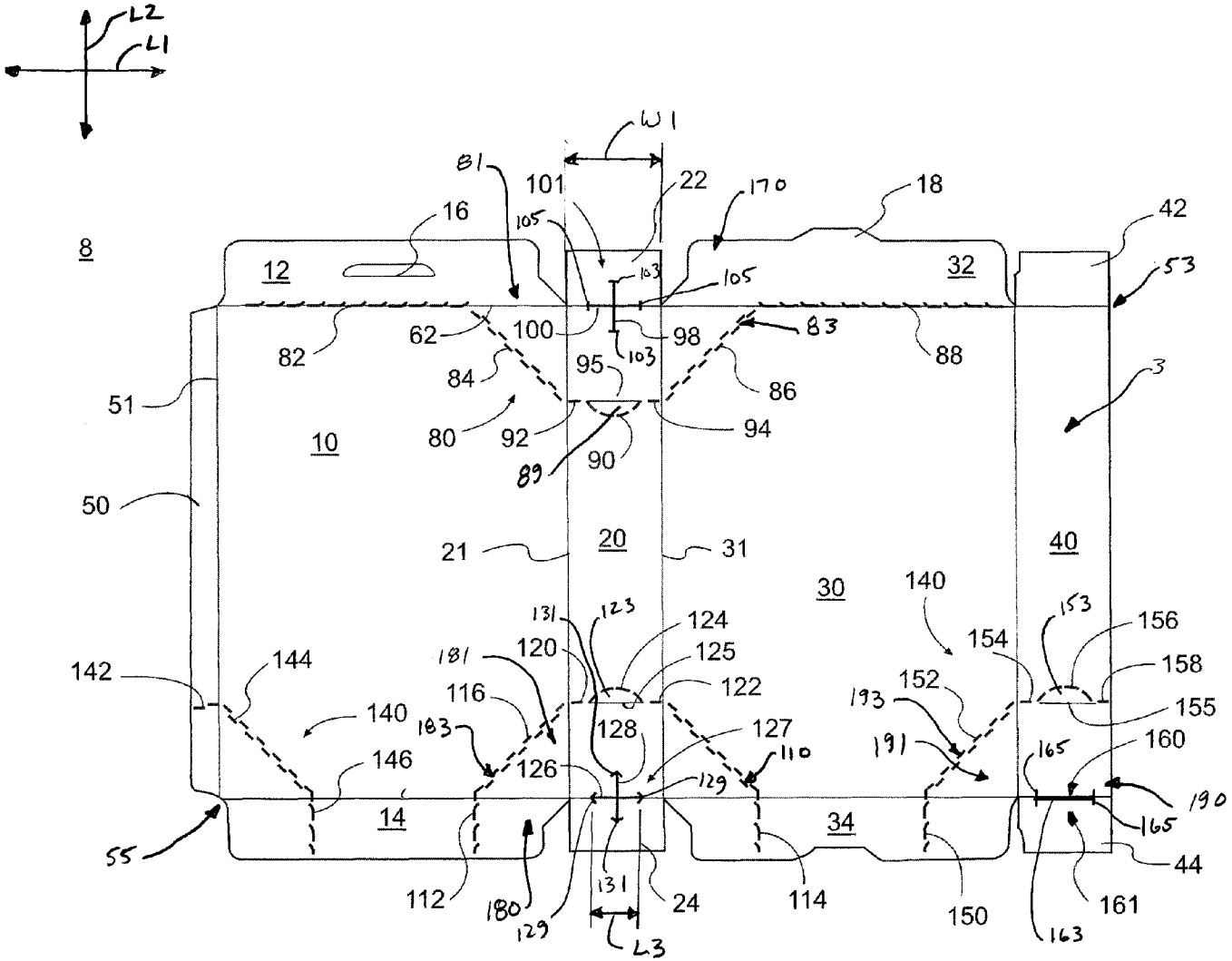
FIG. 1 is a plan view of a blank used to form a carton according to a first embodiment of the invention, the blank of FIG. 1 including three closures each capable of independent use.
Figure 2:
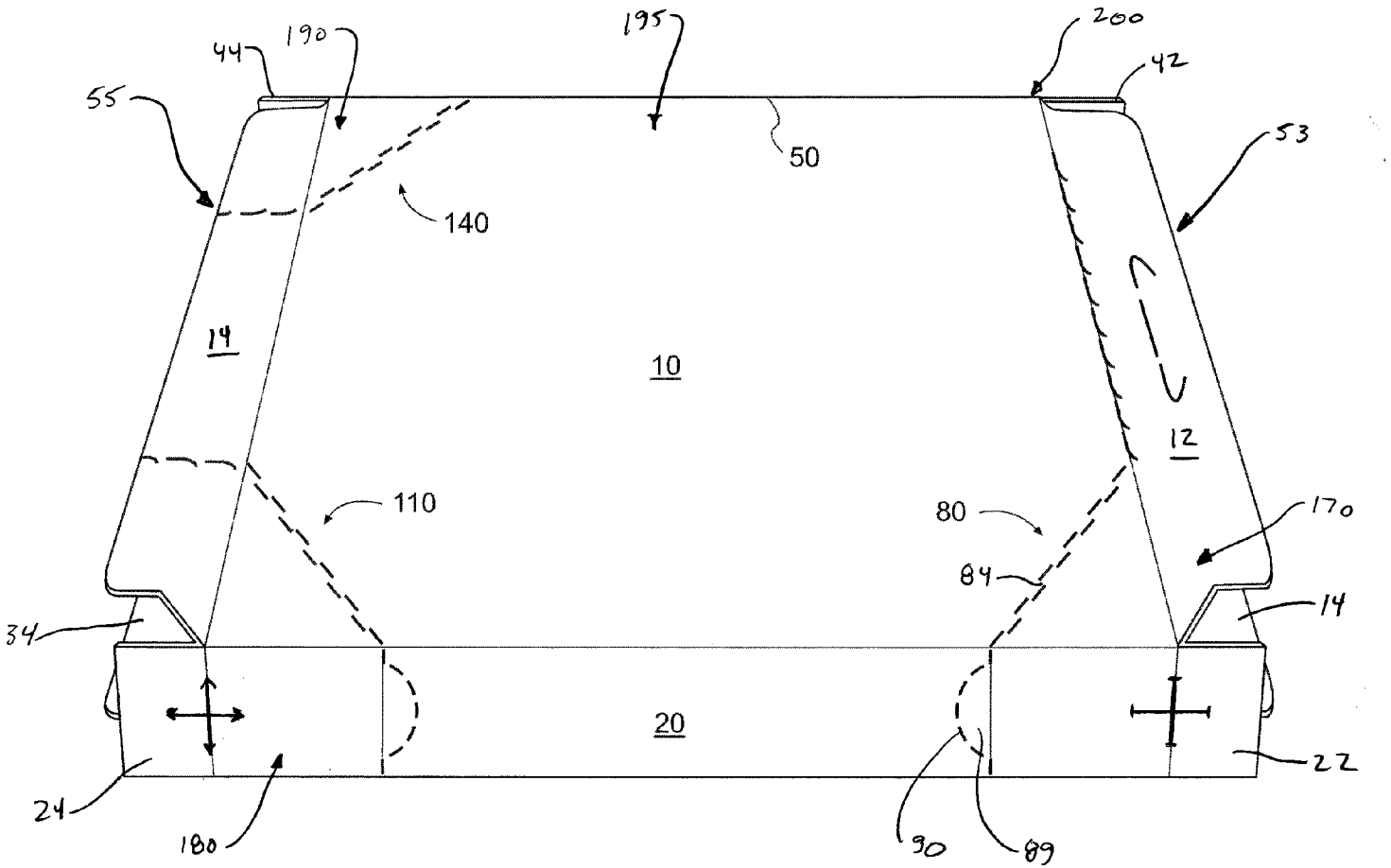
FIG. 2 is a perspective of the carton partially assembled with two open ends.

FIG. 1 is a plan view of a first, exterior side 3 of a blank 8 used to form a carton 200 (illustrated in FIGS. 3-7) having a first bag closure 170, a second bag closure 180, and a third bag closure 190 according to a first embodiment of the invention. The blank 8 has a longitudinal axis L1 and a lateral axis L2. In the illustrated embodiment, the blank 8 comprises a first side panel 10 foldably connected to a first end panel 20 at a first transverse fold line 21, a second side panel 30 foldably connected to the first end panel 20 at a second transverse fold line 31, and a second end panel 40 foldably connected to the second side panel 30 at a third transverse fold line 41. An adhesive flap 50 may be foldably connected to the first side panel 10 at a fourth transverse fold line 51.

The first side panel 10 is foldably connected to a first end flap 12 and a second end flap 14. The first end panel 20 is foldably connected to a first end flap 22 and a second end flap 24. The second side panel 30 is foldably connected to a first end flap 32 and a second end flap 34. The second end panel 40 is foldably connected to a first end flap 42 and a second end flap 44. The first end flaps 12, 22, 32, 42 extend along a top or first marginal area of the blank 8, and may be foldably connected along a first generally longitudinally extending segmented fold line 62. The second end flaps 14, 24, 34, 44 extend along a bottom or second marginal area of the blank 8, and may be foldably connected along a second generally longitudinally extending segmented fold line 64. When the carton 200 is erected, the first end flaps 12, 22, 32, 42 at least partially overlap and close a top end 53 of the carton 200, and the bottom flaps 14, 24, 34, 44 at least partially overlap and close a bottom end 55 of the carton 200. The first and second side top flaps 12, 32 may, for example, include engageable reclosure features 16, 18. In the illustrated embodiment, the carton 200 is generally parallelepiped in shape with four main corners 57, 59, 61, 63, but the carton cold be otherwise shaped to have more or less than four main corners without departing from the invention.

According to a first aspect of the present invention, the blank 8 includes a first closure pattern 80 that defines the first bag closure 170 in the erected carton 200. The first closure pattern 80 defines a first closure panel 81 and is illustrated as extending across the first or top marginal area of the blank 8 generally comprising the top corner 57 of the carton 200. The first closure panel 81 could be otherwise located on the blank 8 without departing from the invention. In the illustrated embodiment, the first closure pattern 80 includes a tear line 83 comprising first and second longitudinally extending portions 82, 88 that may extend along or generally coincide with the longitudinally extending fold line 62. Regarding other portions of the tear line 83, a first oblique portion 84 in the first side panel 10 extends from an end of the first longitudinally extending portion 82 toward the first transverse fold line 21, and a second oblique portion 86 in the second side panel 30 extends from an end of the second longitudinally extending portion 88 toward the second transverse fold line 31. An access flap 89 may be defined in the first end panel 20 by a curved portion 90 of the tear line 83 and a longitudinally extending fold line 95. Longitudinally extending portions 92, 94 of the tear line 83 connect the first and second oblique portions 84, 86, respectively, to the ends of the curved portion 90.

The first closure pattern 80 includes intersecting lines of disruption 98, 100 that define a breachable closure aperture 101 in the blank 8. The intersecting lines of disruption 98, 100 may be, for example, intersecting, orthogonal cuts or slits with transverse cuts 103, 105 at the ends of the orthogonal cuts. In the illustrated embodiment, the lines of disruption 100, 98 are perpendicular and respectively extend generally in the longitudinal and lateral directions L1, L2, but the lines of disruption may be otherwise oriented and positioned without departing from the scope of this invention. In the illustrated embodiment, the closure panel 81 comprises at least a portion of the end panel 20, side panels 10, 30, and overlapped top end flaps 12, 22, 32. Also, the lines of disruption 98, 100 could be lines of weakening other than cuts or slits (e.g., tear lines) without departing from the invention.

According to a second aspect of the present invention, the blank 8 includes a second closure pattern 110 that defines the second bag closure 180 in the assembled carton 200. The second closure pattern 110 defines a second closure panel 181 and is illustrated as extending across the second or bottom marginal area of the blank 8 generally comprising the bottom corner 61 of the carton 200. The second closure panel 181 could be otherwise located on the blank 8. The second closure pattern 110 comprises a tear line 183 having first and second transversely extending portions 112, 114 that extend through the bottom flaps 14, 34, respectively. Regarding other portions of the tear line 183, a first oblique portion 116 extends from an end of the first transversely extending portion 112 toward the transverse fold line 21, and a second oblique portion 118 extends from an end of the second transversely extending portion 114 toward the transverse fold line 31. An access flap 123 is defined in the first end panel 20 by a curved portion 124 of the tear line 183 and a longitudinally extending fold line 125. Longitudinally extending portions 120, 122 of the tear line 183 connect the first and second oblique portions 116, 118, respectively, to the ends of the curved portion 124.

The second closure pattern 110 includes intersecting lines of disruption 126, 128 that define a breachable closure aperture 127 in the blank 8. The intersecting lines of disruption 126, 128 may be, for example, intersecting, orthogonal cuts or slits with transverse, V-shaped cuts 129, 131 at the ends of the orthogonal cuts. In the illustrated embodiment, the lines of disruption 126, 128 are perpendicular and extend generally in the longitudinal and lateral direction, but the lines of disruption may be otherwise oriented and positioned without departing from the scope of this invention. In the illustrated embodiment, the closure panel 181 comprises at least a portion of the end panel 20, side panels 10, 20, and overlapped bottom end flaps 14, 24, 34. Also, the lines of disruption 126, 128 could be lines of weakening other than cuts or slits (e.g., tear lines) without departing from the invention.

According to a third aspect of the present invention, the blank 8 includes a third closure pattern 140 that defines the third bag closure 190 in the assembled carton 200. The third closure pattern 140 defines a third closure panel 191 and is illustrated as extending across the second or bottom marginal area of the blank 8 generally comprising the bottom corner 63 of the blank. In the illustrated embodiment, the third closure panel 191 includes segments on opposite sides of the blank, although it is equally suitable for use at other locations on the blank 8. The third closure pattern 140 includes a tear line 193 that comprises first and second transversely extending portions 146, 150 that extend through the bottom side flaps 14, 34, respectively. A first oblique portion 144 of the tear line 193 extends from an end of the first transversely extending portion 146 in the side panel 10 toward the fourth transverse fold line 51, and a second oblique portion 152 extends from an end of the second transversely extending portion 150 in the second side panel 30 toward the third transverse fold line 41. An access flap 153 is defined in the second end panel 40 by a curved portion 156 of the tear line 193 and a longitudinally extending fold line 155. Longitudinally extending portions 154, 158 of the tear line 193 extend from the ends of the curved portion 156. The longitudinal portion 154 connects the second oblique portion 152 to one end of the curved portion 156. The longitudinal portion 158 is aligned with a longitudinal portion 142 in the adhesive flap 50 in the erected carton 200.

The third closure pattern 140 includes lines of disruption 160 that define a breachable closure aperture 161 in the blank 8. In the illustrated embodiment, the lines of disruption 160 include a longitudinally extending cut or slit 163 with transverse cuts 165 at the ends of the cut. In the illustrated embodiment, the longitudinal cut 163 and the transverse cuts 165 have a general "I" shape, but the lines of disruption 160 could be otherwise shaped and arranged without departing from the invention. In the illustrated embodiment, the closure panel 191 comprises at least a portion of the end panel 40, side panels 10, 20, and overlapped bottom end flaps 14, 24, 34. Also, the lines of disruption 160 could be lines of weakening other than cuts or slits (e.g., tear lines) without departing from the invention.

The lines of disruption 84, 86, 92, 94, 116, 118, 142, 144, 154, 158 in the blank 8 are generally illustrated as tear lines formed by offset cuts comprising 100% cuts (i.e., slits that extend through the entire blank). However, partial cuts, which may be alone or in combination with other lines of disruption, for example, may also be used. The lines of disruption 82, 88, 112, 114, 146, 150 and 98, 100, 160, 126, 128 may also be formed from 100% and/or partial cuts, alone or in combination with other lines of disruption. If cuts are used to form tear lines or other lines of disruption in the blank 8, the cuts can be, for example, interrupted by one or more nicks.

In one embodiment, the slits 98, 100, 126, 128, 163 are generally elongate and have a length L3 (FIG. 1) generally in the range of approximately 25% to 100% of the width W1 (FIG. 1) of the end panels 20, 40. In one embodiment, the width W1 is approximately 2 inches (50 mm) and the length L3 is approximately 1¼ inches (31 mm). These dimensions are exemplary and are not to be construed as limiting the scope of the invention.

An exemplary process of erecting the carton 200 will be discussed with reference to FIGS. 1-5. Adhesive is applied to the adhesive panel or flap 50 on the exterior side of the flap 50. The adhesive can be, for example, liquid glue, glue strips, or other compositions. The carton blank 8 is then folded so that the exterior or print side of the adhesive panel 50 adheres to the interior side of the second end panel 40. The blank 8 may then be formed into a generally open-ended sleeve 195 (FIG. 2) having a generally tubular form with top and bottom ends 53, 55 being open. The open top end 53 of the sleeve 195 may be closed by folding and adhering the top end flaps 12, 22, 32, 42 together to form a top panel 166, and the open bottom end 55 may be closed by folding and adhering the bottom end flaps 14, 24, 34, 44 together to form a bottom panel 168. In the erected carton 200, the top end flaps 12, 22, 32, 42 overlap to form the closed top end 53, and the bottom flaps 14, 24, 34, 44 overlap to form the closed bottom end 55. A bag B (FIGS. 8-10), or other container, filled with food product may be inserted in the carton 200 in a conventional manner such as after the bottom end 53 has been closed or prior to closing any of the top and bottom end flaps 12, 22, 32, 42, 14, 24, 34, 44.

Figure 3:
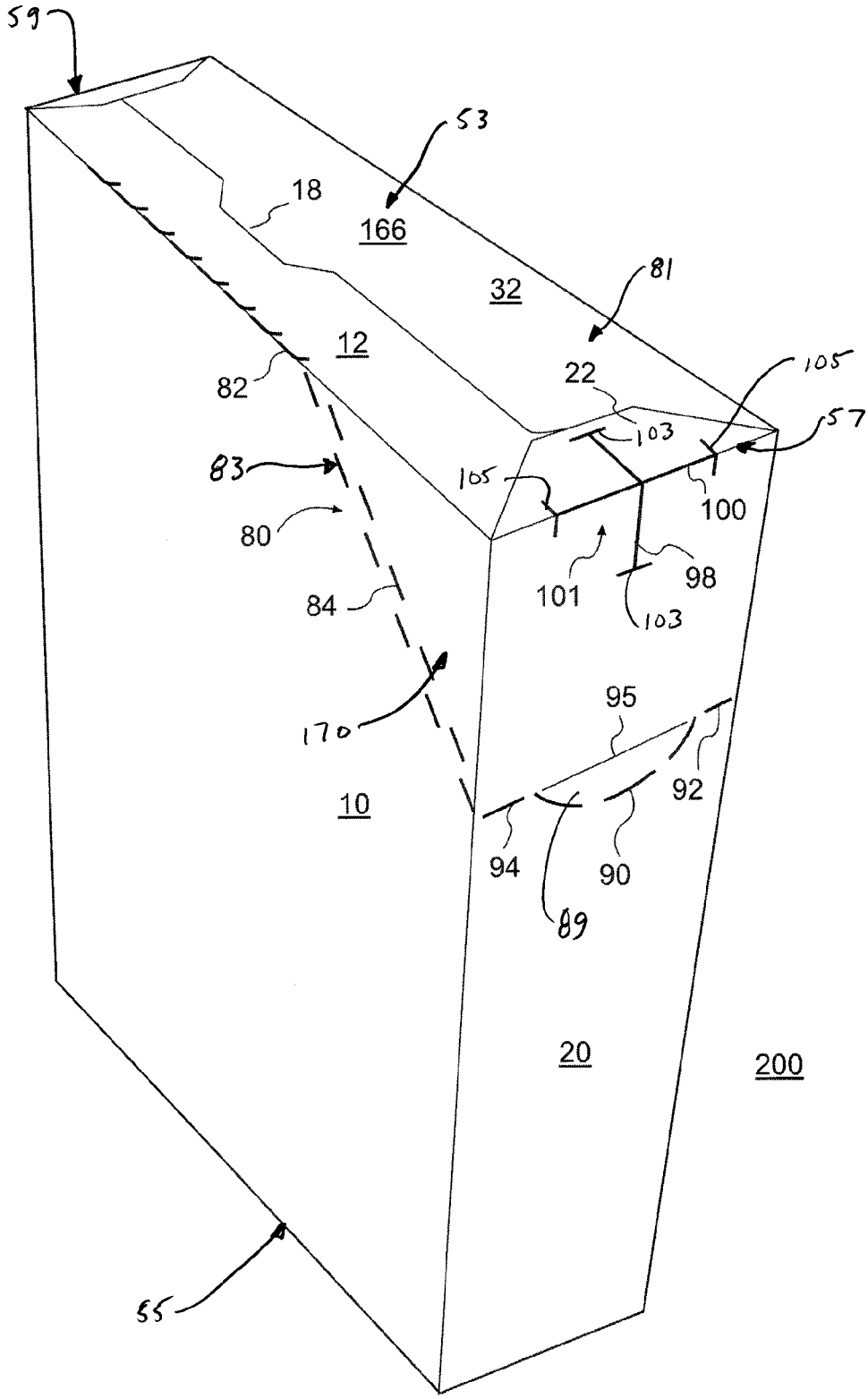
FIG. 3 is a perspective of the assembled and closed carton showing a first closure.
Figure 10:
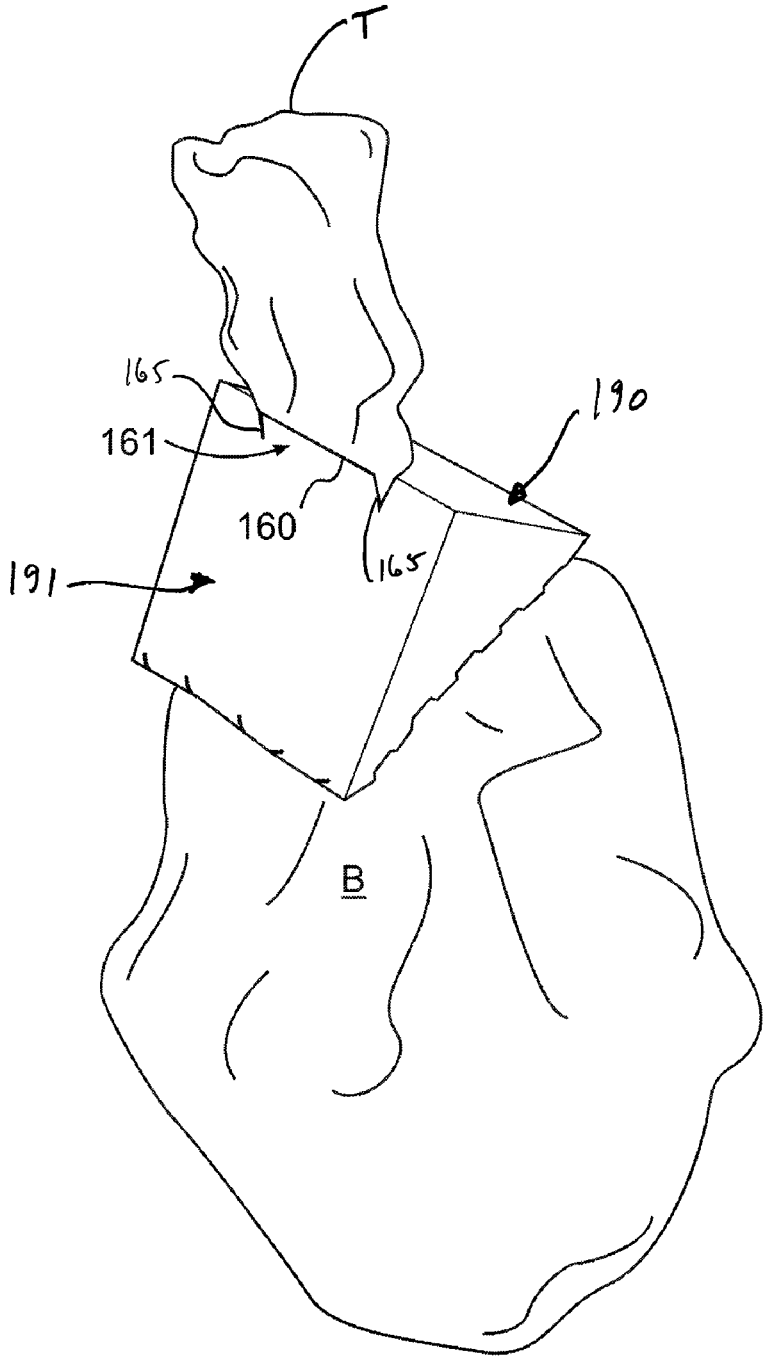
FIG. 10 is a view similar to FIG. 8 but showing the third closure in use.

FIG. 3 illustrates the erected carton 200 with the first closure pattern 80 that defines the first bag closure 170 (illustrated in FIG. 10). The first closure pattern 80 may extend around an upper corner 57 of the carton 200, with the intersecting lines of disruption 98, 100 that define the breachable closure aperture 101 extending through the top panel 166 and through the first end panel 20. The perimeter of the first closure pattern 80 extends along the fold line 62 (shown in FIG. 1) separating the side panels 10, 30 and the top panel 166, and through the first and second side panels 10, 30. The first closure pattern 80 enables partial or complete removal of the first bag closure 170 from the remainder of the erected carton 200.

Figure 4:
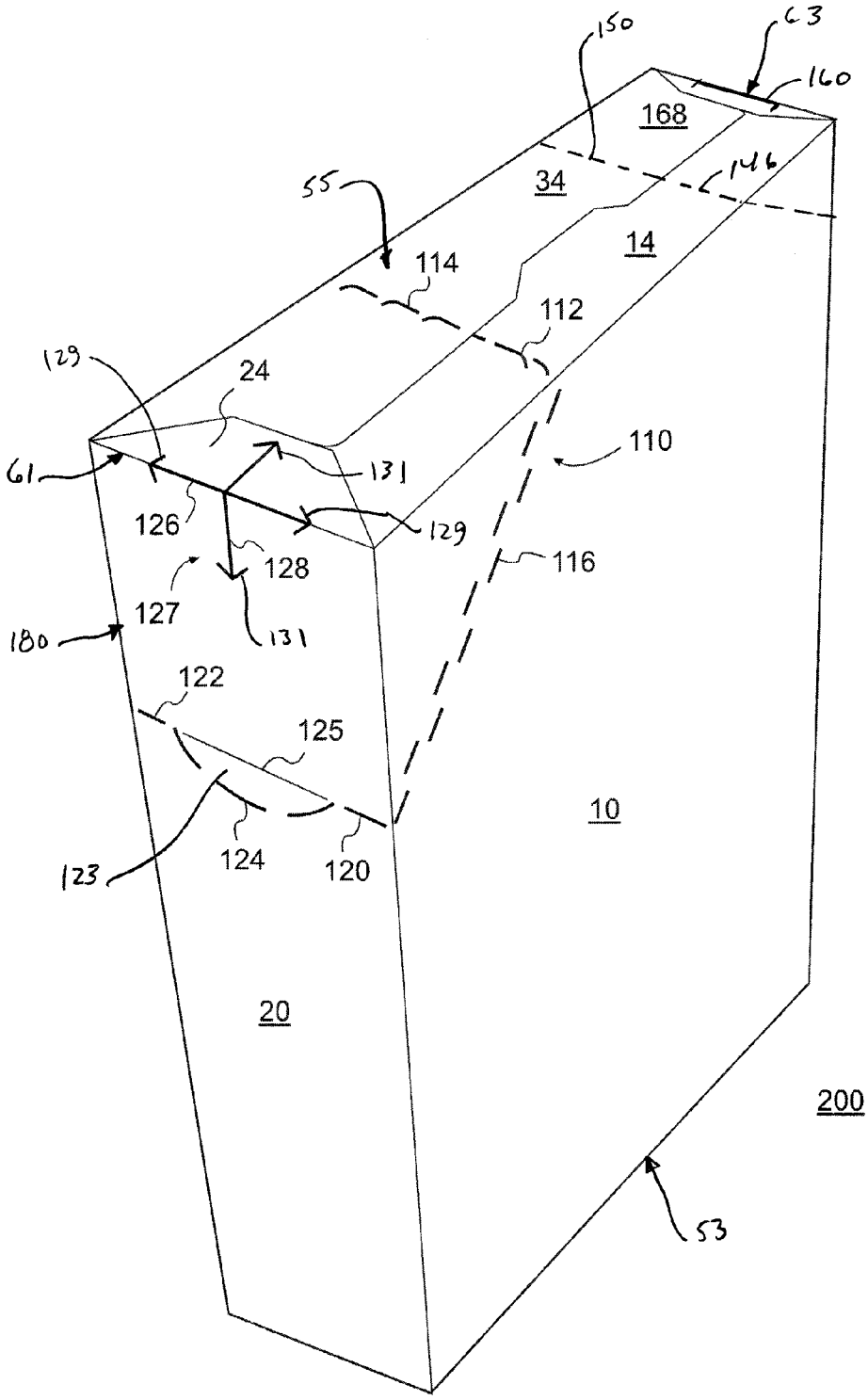
FIG. 4 is a perspective of the assembled and closed carton showing a second closure.

FIG. 4 shows the second closure pattern 110 that defines the second bag closure 180 of the erected carton 200. The second closure pattern 110 extends around the bottom corner 61 of the carton 200, with the lines of disruption 126, 128 that define the breachable closure aperture 127 extending across the bottom panel 168 and the first end panel 20. The perimeter of the second closure pattern 110 extends through the bottom panel 168, the first and second side panels 10, 30, and through the first end panel 20. The second closure pattern 110 enables partial or complete removal of the second bag closure 180 from the remainder of the erected carton 200.

Figure 5:
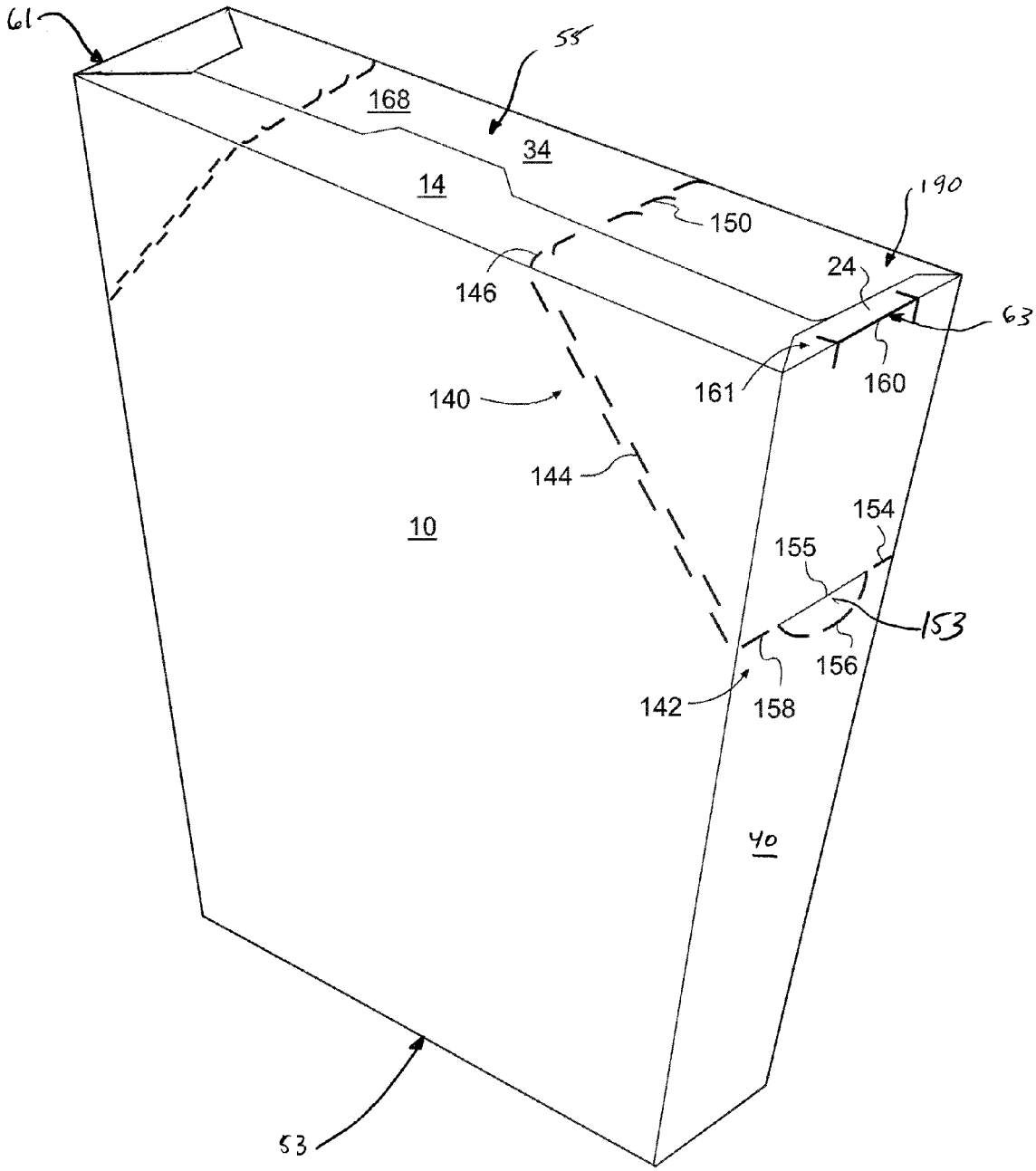
FIG. 5 is a perspective of the assembled and closed carton showing a third closure.

FIG. 5 shows the third closure pattern 140 that defines the third bag closure 190 of the erected carton 200. The third closure pattern 140 extends around the bottom corner 63 of the carton 200, with the line of disruption 160 that defines the breachable closure aperture 161 extending across the bottom panel 168 and the second end panel 40. The perimeter of the third closure pattern 140 extends across the bottom panel 168, the second end panel 40, and the first and second side panels 10, 30. The third closure pattern 140 enables partial or complete removal of the third bag closure 190 from the remainder of the erected carton 200.

Figure 6:
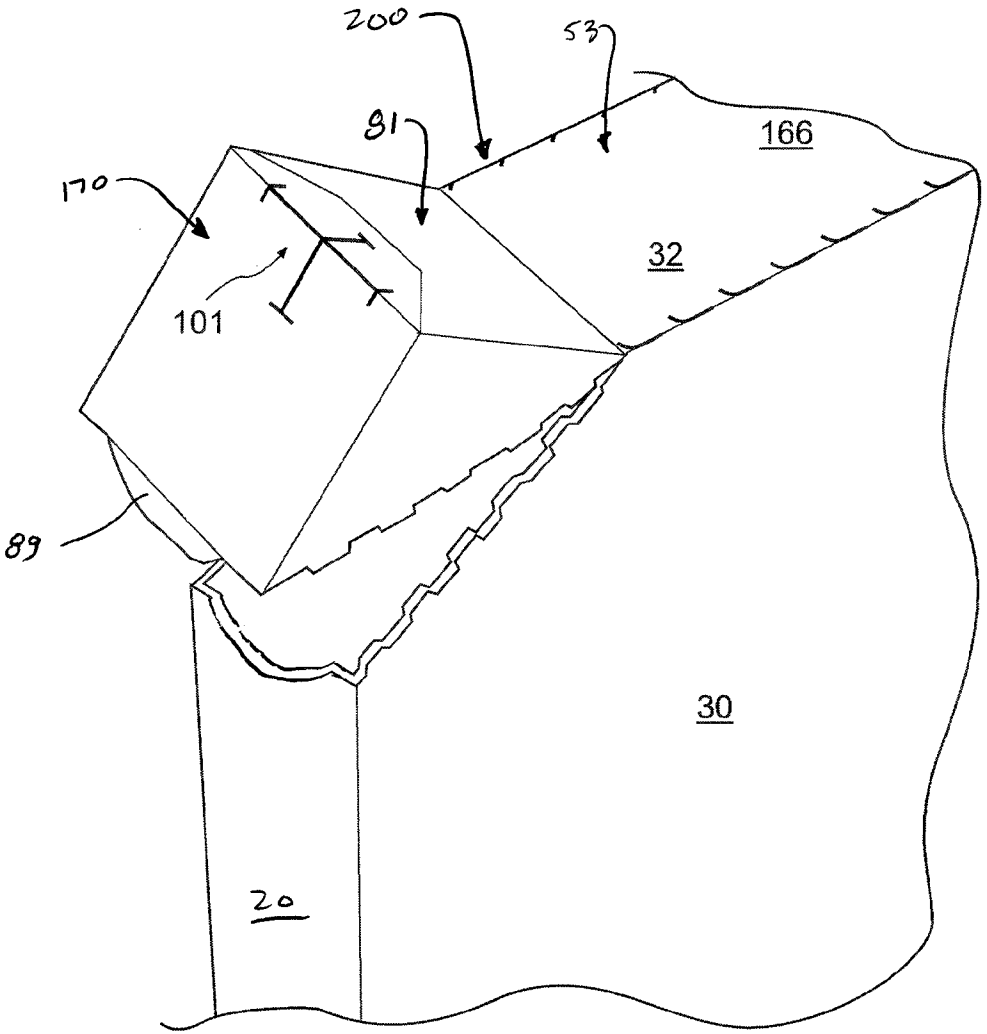
FIG. 6 is a detail perspective showing the first closure partially removed from the carton.
Figure 7:
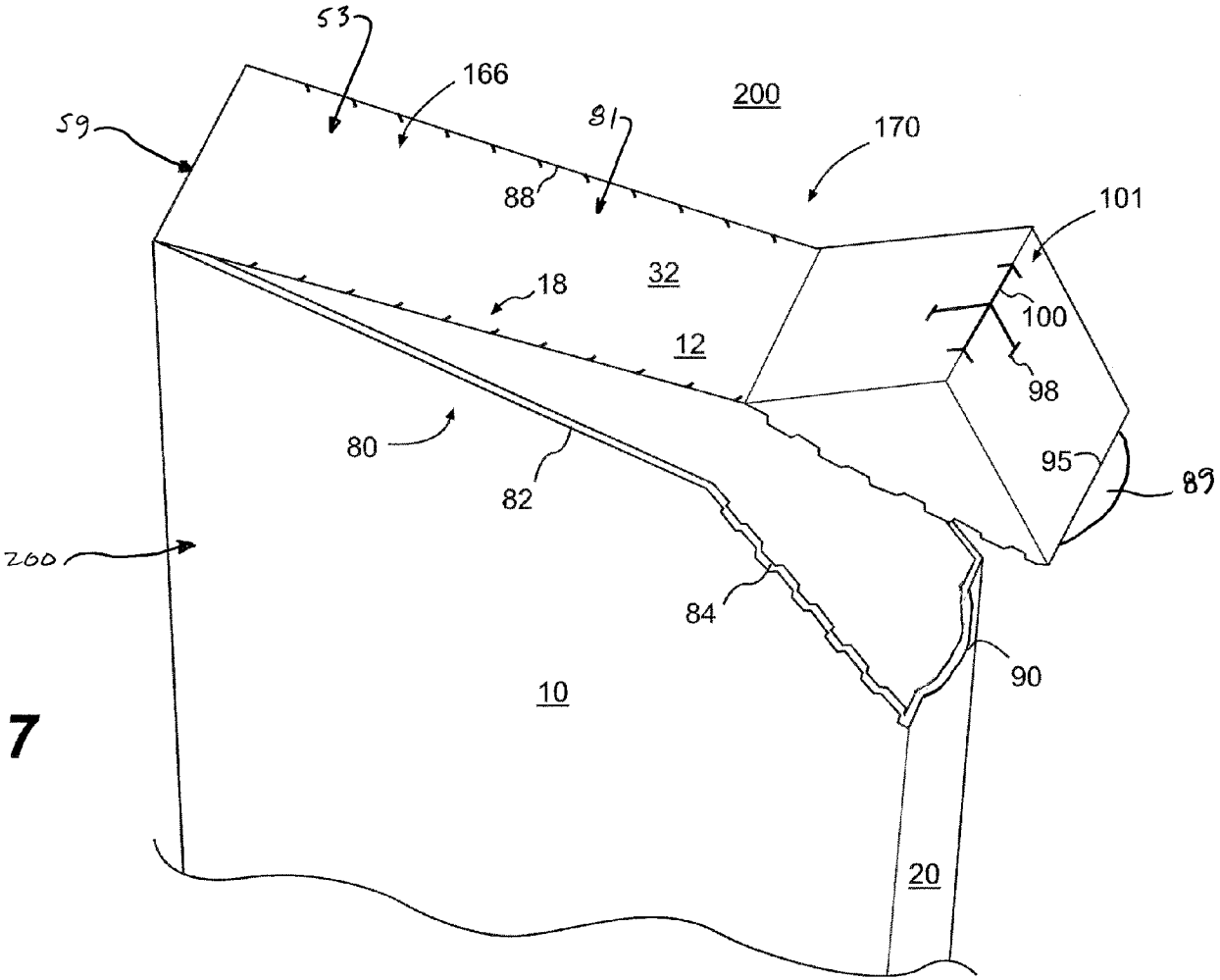
FIG. 7 is a perspective showing the first closure further partially removed.
Figure 8:
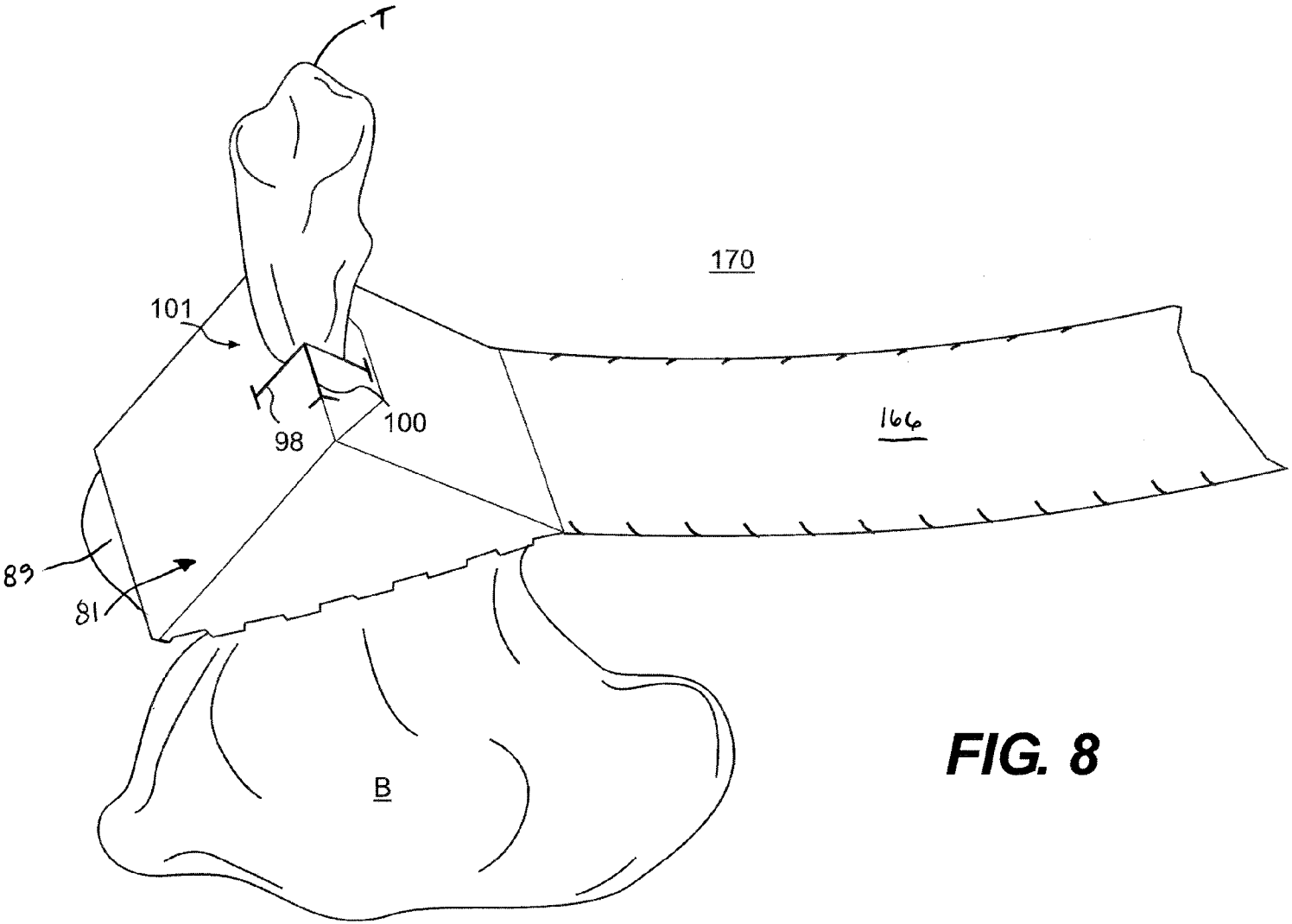
FIG. 8 is a perspective showing the first closure removed from the carton and fitted onto a container to close an open end of the container.

FIGS. 6 and 7 illustrates the first bag closure 170 being removed from the carton 200, and FIG. 8 illustrates the first bag closure 170 separated from the carton. Referring to FIGS. 6 and 7, the carton 200 may be breached at the curved portion 90 of the tear line 83 in the first end panel 20, and the upper portion of the carton 200 may be torn along the portions 84, 86, 82, 88 of the tear line. Referring to FIG. 8, the top end panel 166 and portions of the first and second side panels 10, 30 and the first end panel 20 may be removed from the remainder of the carton 200. The closure panel 81 removed from the carton 200 forms the first bag closure 170. A bag B accommodated within the carton 200 may now be opened and removed through the open top end of the carton. A desired amount of dispensable material may be removed from the bag B. After dispensing the dispensable material, the opened top end T of the bag may then be pressed through the breachable closure aperture 101 to partially close or seal the open bag top T. The first bag closure 170 may, as shown in FIG. 10, include a significant portion of the top panel 166. The surface area of the top panel 166 removed from the carton 200 can be used, for example, to retain product identifying indicia that may be used to identify the contents of a bag sealed by the first closure 170. It is understood that other steps may be used to activate the first bag closure 170 and seal the bag B. For example, the bag B may remain in the carton 200 while dispensing the dispensable material and the closure 170 may be used to seal the open top of the bag B without removal of the bag from the carton.

Figure 9:
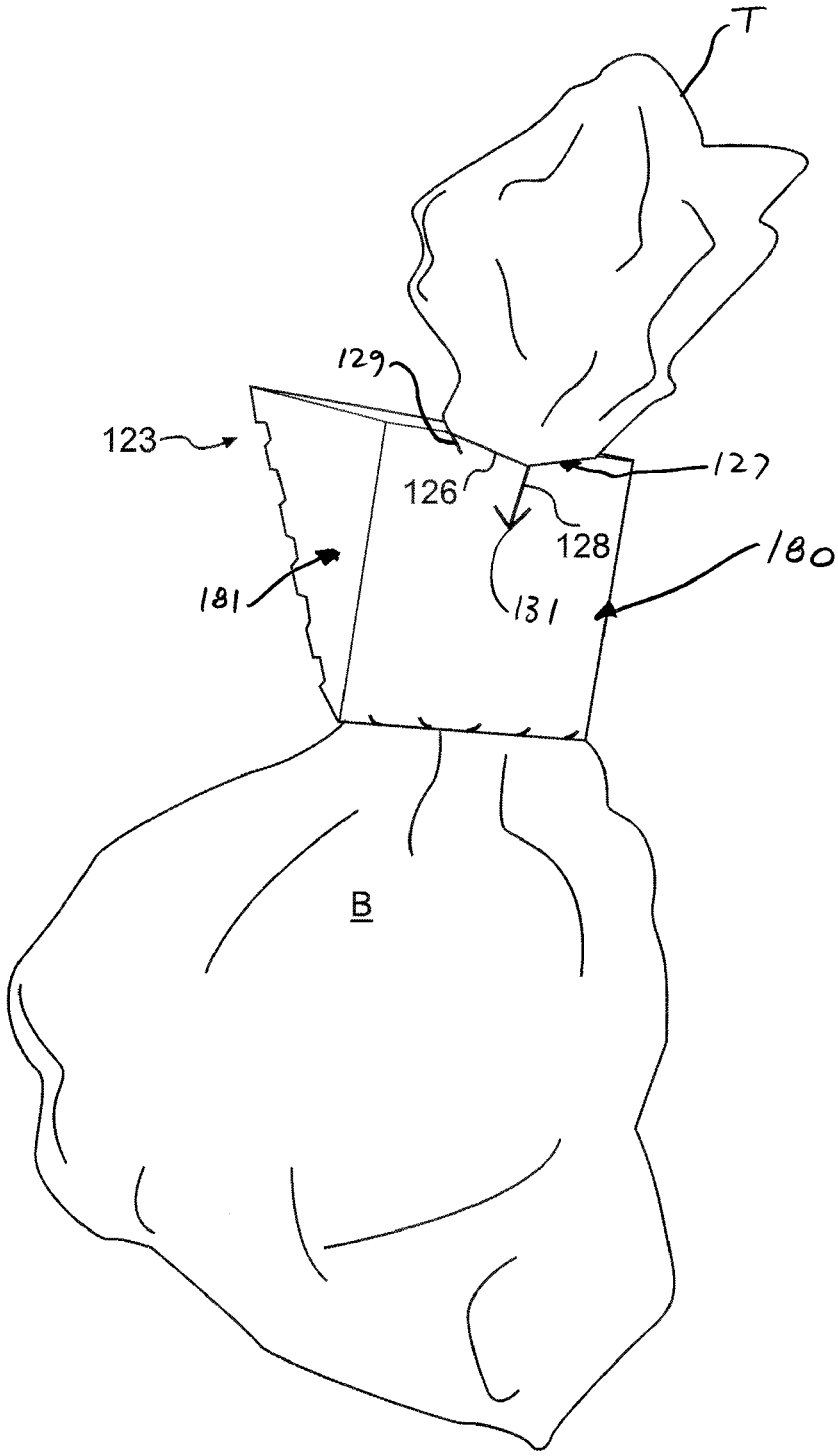
FIG. 9 is a view similar to FIG. 8 but showing the second closure in use.

In one alternative, the carton 200 may be opened by separating top end flaps 12, 32 to access the bag B in the carton. In this embodiment, either the second bag closure 180 or the third bag closure 190 may be removed from the carton 200 and used to close the bag B. FIG. 9 illustrates the second bag closure 180 after removal from the carton 200 and with the upper, opened top T of a bag B pressed through the second breachable closure aperture 127 in the second closure panel 181.

FIG. 10 illustrates the third bag closure 190 removed from the carton 200 with the opened top T of the bag B pressed through the third breachable closure aperture 161. The second and third bag closures 180, 190 can be removed from their respective corners 61, 63 of the carton 200 along the perimeters of their respective closure patterns 110, 140.

In another alternative method of use, the first bag closure 170 remains attached to the carton 200 during use. In this application, the first bag closure 170 may be only partially torn from the carton 200 a degree sufficient to allow access to a bag within the carton. For example, the first bag closure 170 can be separated from the remainder of the carton 200 along the side panels 10, 30, yet remain pivotally attached at the intersection of the second end panel 30 and the top panel 166 as shown in FIG. 7. The pivotally attached closure 170 may be pivoted upward at top corner 59 of the carton to allow the bag B to be removed. After the bag B is opened, material dispensed, and the bag returned to the carton, the top end T of the bag can be pulled through the closure aperture 101 of the pivotally attached bag closure 170. Also, the bag closure 170 could remain pivotally attached to the carton 200 as shown in FIG. 6 and material may be dispensed from the bag B through the opening created by pivoting the closure panel 81 upward. The top T of the bag could then be sealed using the bag closure 170 that remains attached to the carton 200.

A bag is disposed within the carton embodiment discussed above. The bag can hold, for example, food products and other dispensable material or products. According to the above embodiments, a "bag" can be a fully or partially sealed vessel or container for accommodating, for example, dispensable items. Examples of such vessels include sealed and unsealed bags formed from wax paper, all-plastic bags, paper bags, and coated paper bags.

Each of the bag closure patterns discussed above can be located at any corner of the carton 200. Further, the closure apertures 101, 127, 161 in the carton 200 may be interchanged with one another among the individual closure patterns 80, 110, 140.

The blank 8 of the illustrated embodiment includes the three bag closures 170, 180, and 190. It is understood that the blank 8 could include any one of the bag closures 170, 180, 190 without departing from the scope of this invention. Further, any of the bag closures 170,180, 190 could be applied to other blank/carton designs such as other existing carton designs without significant additional cost.

According to the above-described embodiments, the bag closures can enclose a bag contents with a relatively tight and secure seal. The seal is particularly advantageous when product held within the carton is perishable or otherwise sensitive to the outside environment, or when the contents of the bag may accidentally dispense or become compromised by an outside source.

In any of the bag closures discussed above, a significant portion of the top, bottom, or other panels of the carton can remain attached to the bag closures when the bag closures are removed. The surface area of the bottom or top panel can include, for example, identifying product indicia that allows the bag contents to be easily identified.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines can include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carton for containing a bag having dispensable material therein, the carton comprising:

a plurality of panels that extend at least partially around an interior of the carton, the plurality of panels comprises a first end panel, a second end panel, a first side panel, and a second side panel;

at least two end flaps respectively foldably attached to respective panels of the plurality of panels, wherein the end flaps are overlapped with respect to one another and thereby at least partially form a closed end of the carton;

a closure removably attached to the carton with the closure having an aperture for receiving at least a portion of the bag to close the bag and seal the material held therein, the closure comprises a closure panel that is at least partially defined by a tear line in the carton and is for being at least partially removed from the carton, the closure panel having the aperture formed therein and the closure panel comprising at least a portion of the first side panel, at least a portion of the second side panel, at least a portion of at least one of the first and second end panels, and at least a portion of the at least two end flaps.

2. The carton of claim 1 wherein the carton comprises at least one corner and the closure panel comprises the corner.

3. The carton of claim 1 wherein at least two end flaps cooperate to form a closed top of the carton.

4. The carton of claim 1 wherein the closure panel comprises an access flap for grasping the closure panel.

5. The carton of claim 1 wherein the tear line comprises at least one longitudinal portion and at least one oblique portion in at least one of the first and second side panels.

6. The carton of claim 1 wherein the tear line comprises at least one lateral portion and at least one oblique portion in at least one of the first and second side panels.

7. The carton of claim 1 wherein the aperture is formed by at least one line of disruption in the closure panel.

8. The carton of claim 7 wherein the at least one line of disruption comprises at least one cut.

9. A carton for containing a bag having dispensable material therein, the carton comprising:

a plurality of panels that extend at least partially around an interior of the carton; and a closure removably attached to the carton with the closure having an aperture for receiving at least a portion of the bag to close the bag and seal the material held therein, the closure comprises a closure panel that is at least partially defined by a tear line in the carton and is for being at least partially removed from the carton, the closure panel having the aperture formed therein, the aperture is formed by at least one line of disruption in the closure panel and the at least one line of disruption comprises at least one cut, wherein the at least one cut comprises two orthogonal cuts that intersect in the closure panel.

10. The carton of claim 9 wherein the orthogonal cuts each have a transverse cut at a respective end.

11. The carton of claim 10 wherein each transverse cut is perpendicular to a respective one of the orthogonal cuts.

12. The carton of claim 10 wherein each transverse cut is generally V-shaped.

13. The carton of claim 7 wherein the at least one line of disruption is a slit.

14. The carton of claim 1 in combination with a bag containing dispensable material, the dispensable material comprising a perishable foodstuff, and the bag being within the interior of the carton.

15. A blank for forming a carton comprising:

a plurality of panels comprising a first end panel, a second end panel, a first side panel, and a second side panel;

at least two end flaps respectively foldably attached to respective panels of the plurality of panels, wherein the end flaps are overlapped with respect to one another and thereby at least partially form a closed end of a carton formed from the blank; and a closure panel at least partially defined by a tear line in the blank, the closure panel having an elongate aperture formed therein, the closure panel comprises at least a portion of the first side panel, the second side panel, at least one of the first and second end panels, and at least a portion of the at least two end flaps.

16. A blank for forming a carton comprising:

a plurality of panels comprising a first end panel, a second end panel, a first side panel, and a second side panel;

at least two end flaps respectively foldably attached to respective panels of the plurality of panels, wherein the end flaps are overlapped with respect to one another and thereby at least partially form a closed end of a carton formed from the blank; and a closure panel at least partially defined by a tear line in the blank, the closure panel having an elongate aperture formed therein, wherein the aperture is formed by at least one line of disruption in the closure panel, the at least one line of disruption comprises two orthogonal cuts that intersect in the closure panel.

17. The blank of claim 16 wherein the orthogonal cuts each have a transverse cut at a respective end, each transverse cut being substantially perpendicular to a respective one of the orthogonal cuts.

18. The blank of claim 16 wherein the at least one line of disruption comprises a slit, the slit being at least approximately 25% of a width of at least one of the first end panel and the second end panel.

19. A method of closing a bag containing dispensable material, the method comprising:

obtaining a carton for housing the bag, the carton having a plurality of panels that extend at least partially around an interior of the carton, the plurality of panels comprises a first end panel, a second end panel, a first side panel, and a second side panel, the carton comprising at least two end flaps respectively foldably attached to respective panels of the plurality of panels, the end flaps are overlapped with respect to one another and thereby at least partially form a closed end of the carton, and a closure removably attached to the carton having an aperture, the closure comprising a closure panel that is at least partially defined by a tear line in the carton, the closure panel having the aperture formed therein and the closure panel comprising at least a portion of the first side panel, at least a portion of the second side panel, at least a portion of at least one of the first and second end panels, and at least a portion of the at least two end flaps;

at least partially removing the closure from the carton by at least partially separating the closure panel from the carton at the tear line;

closing the bag by inserting at least a portion of the bag through the aperture in the closure panel to seal the material therein.

20. The method of claim 19 at least partially removing the closure comprises tearing the carton along the tear line and removing the closure panel from the carton.

21. The method of claim 20 further comprising:

opening the carton;

opening the bag;

at least partially removing the dispensable material from the bag; and removing the opened bag from the container prior to closing the bag.

22. The method of claim 21 further comprising placing the closed bag in the opened carton for storing the material prior to a subsequent use.

23. The carton of claim 1 wherein the tear line defines a peripheral edge of the closure panel, the aperture being located in the closure panel at an interior location spaced inward from the peripheral edge.

24. The blank of claim 15 wherein the tear line defines a peripheral edge of the closure panel, the aperture being located in the closure panel at an interior location spaced inward from the peripheral edge.

* * * * *